US008898859B2

(12) United States Patent
Song

(10) Patent No.: US 8,898,859 B2
(45) Date of Patent: Dec. 2, 2014

(54) VACUUM CLEANER

(75) Inventor: Byung-Ho Song, Anyang-si (KR)

(73) Assignee: Tekforus Inc. (KR)

( * ) Notice: Subject to any disclaimer, the term of this patent is extended or adjusted under 35 U.S.C. 154(b) by 0 days.

(21) Appl. No.: 13/521,502

(22) PCT Filed: Jun. 29, 2011

(86) PCT No.: PCT/KR2011/004754

§ 371 (c)(1),
(2), (4) Date: Jul. 26, 2013

(87) PCT Pub. No.: WO2012/074177

PCT Pub. Date: Jun. 7, 2012

(65) Prior Publication Data

US 2013/0298349 A1 Nov. 14, 2013

(30) Foreign Application Priority Data

Nov. 29, 2010 (KR) ..... 10-2010-0119490

(51) Int. Cl.

| | |
|---|---|
| ***A47L 9/04*** | (2006.01) |
| ***A47L 9/02*** | (2006.01) |
| ***A47L 5/24*** | (2006.01) |
| ***A47L 9/10*** | (2006.01) |
| ***A47L 7/00*** | (2006.01) |

(52) U.S. Cl.

CPC ... *A47L 9/10* (2013.01); *A47L 9/02* (2013.01); *A47L 5/24* (2013.01); *A47L 9/0483* (2013.01); *A47L 7/008* (2013.01)

USPC ..... 15/382; 15/381; 15/378; 15/422

(58) Field of Classification Search

USPC ..... 15/381, 382, 378, 422

IPC ..... A47L 9/04

See application file for complete search history.

(56) References Cited

U.S. PATENT DOCUMENTS

| | | | | |
|---|---|---|---|---|
| 6,073,302 | A * | 6/2000 | Buscher | 15/339 |
| 7,444,711 | B2 * | 11/2008 | Garcia et al. | 15/324 |
| 7,669,283 | B2 * | 3/2010 | Dever | 15/375 |

FOREIGN PATENT DOCUMENTS

| | | | |
|---|---|---|---|
| JP | 09047391 | A | 2/1997 |
| KR | 1020030005598 | A | 1/2003 |
| KR | 1020040045541 | A | 6/2004 |
| KR | 100806644 | B1 | 2/2008 |

OTHER PUBLICATIONS

International Search Report, dated Feb. 15, 2012 of International Application No. PCT/KR2011/004754.

* cited by examiner

*Primary Examiner* — David Redding

(74) *Attorney, Agent, or Firm* — Kaplan Breyer Schwarz & Ottesen, LLP

(57) ABSTRACT

A vacuum cleaner comprising: a secured tube secured horizontally to the front surface of the main body of the cleaner and sucks in dust from the outside due to a motor in the main body; a pair of securing members which secure two ends of the secured tube to the main body and convey the sucked-in dust to a filter in the main body; and a suction tube which is rotatably provided on the outer circumferential surface of the secured tube and rolls along the surface to be cleaned, and in the cylindrical surface of which are formed dust-suction holes for sucking in dust. Because the suction tube in which the plurality of dust-suction holes are formed is rotatably provided on the outer circumferential surface of the secured tube, the suction tube continuously turns while cleaning bedding by pushing or pulling the main body, and thus the bedding is not sucked into the secured tube.

6 Claims, 5 Drawing Sheets

VACUUM CLEANER

FIELD OF THE INVENTION

The present invention relates to a vacuum cleaner, and more particularly, to a vacuum cleaner that facilitates cleaning of bedclothes such as a blanket.

BACKGROUND OF THE INVENTION

Vacuum cleaners, which are also called electric vacuums, use vacuum suction to remove dust from, e.g., a carpet laid on a floor. Vacuum cleaners can efficiently and thoroughly clean a large indoor space with a plug inserted in a wall outlet. After the cleaning, the vacuum cleaner is turned off, and the plug is pulled out. Then, a cover of a dust container is opened to remove collected dust.

Such a vacuum cleaner includes a suction port, a motor, a rotor, a filter, a dust collecting case, and a discharge port. An operation of a vacuum cleaner is as follows: a commutator motor rotates a rotor at 10,000 or greater rpm to form a vacuum in the vacuum cleaner, thereby suctioning a foreign substance such as dust through a suction port; and the suctioned foreign substance is filtered out by a filter, and air is discharged through a discharge port. Furthermore, such vacuum cleaners have a function of automatically winding a power cord. In addition, while the power cord is wound or unwound, a gear is operated to automatically remove dust from a filter. The suction port of vacuum cleaners is designed to be conveniently used according to service spaces.

Vacuum cleaners are classified into hand type ones, upright type ones, pot type ones, and cylinder floor type ones. Hand type vacuum cleaners are appropriate to remove dust from a desk, a shelf, or a suit. Upright type vacuum cleaners are lighter than hand type vacuum cleaners in terms of weight applied to a user's hand, and are thus appropriate to clean a floor, but dust collecting capacity thereof is small. Cylinder floor type vacuum cleaners have large dust collecting capacity, and are thus appropriate for home use. Cylinder floor type vacuum cleaners have a power consumption of about 600 W, and may be designed to significantly decrease motor noise.

When such a typical vacuum cleaner suctions, through the suction port, a foreign substance such as dust from flexible bedclothes such as a blanket, a portion of the bedclothes may be suctioned into the suction port, thus degrading cleaning efficiency.

SUMMARY OF THE INVENTION

Accordingly, the present invention is directed to a vacuum cleaner that substantially obviates one or more problems due to limitations and disadvantages of the related art. The present invention provides a vacuum cleaner that prevents a portion of bedclothes such as a blanket from being suctioned thereinto, thereby efficiently cleaning the bedclothes.

The present invention provides a vacuum cleaner including: a stationary tube laterally fixed to a bottom of a cleaner main body to suction dust from an outside by an operation of a vacuum motor disposed within the cleaner main body; a pair of fixing members fixing both ends of the stationary tube to the cleaner main body, and transferring the suctioned dust to a filter part disposed within the cleaner main body; and a suction tube rotatably installed on an outer circumferential surface of the stationary tube, and rolling along a cleaning target surface, and comprising dust suction holes in a circumferential surface thereof to suction dust.

A dust introduction hole may be disposed in a lower portion of the stationary tube and be elongated along the longitudinal direction of the stationary tube to introduce dust suctioned through the dust suction holes of the suction tube, the fixing members may include transfer tubes, respectively, which transfer the dust introduced through the dust introduction hole, to the filter part, and the suction tube may rotate, entirely surrounding a portion of the outer circumferential surface of the stationary tube between the fixing members.

The fixing members may include stationary tube insertion holes in which both the ends of the stationary tube are inserted, key seats may be disposed in inner portions of the stationary tube insertion holes, and keys may be disposed on circumferences of both the ends of the stationary tube, and be inserted in the key seats to prevent rotation of the stationary tube.

The vacuum cleaner may further include an ultraviolet sterilization lamp on the cleaner main body in front of the stationary tube.

The vacuum cleaner may further include a beating device on the cleaner main body in front of the stationary tube to beat a cleaning target surface, wherein the beating device includes: a beating motor disposed within the cleaner main body; a cam member coupled to a driving shaft of the beating motor; a beating part allowed to protrude from the bottom of the cleaner main body; and a link member having an upper end hinged to the cam member, and a lower end hinged to an upper end of the beating part.

The vacuum cleaner may further include: a first sensor disposed on the bottom of the cleaner main body, wherein when the cleaner main body is raised from a floor, the first sensor senses the raising of the cleaner main body to stop an operation of the ultraviolet sterilization lamp; and a second sensor disposed within the cleaner main body, and sensing a removal of the filter part to stop an operation of the vacuum motor.

An entire area of the dust introduction hole may be equal to an entire area of an air introduction hole disposed in a side portion of an air suction room accommodating the vacuum motor.

According to the embodiments of the present invention, the following effects can be attained.

First, since the suction tube having the dust suction holes is rotatably installed on the outer circumferential surface of the stationary tube, when the cleaner main body is pushed and pulled to clean bedclothes, the suction tube is continually rotated. Thus, a portion of the bedclothes can be prevented from being suctioned into the stationary tube, and a user can efficiently and conveniently clean the bedclothes.

Secondly, since the beating device beats bedclothes during a cleaning process, a foreign substance such as dust, dust mites, and germs are removed from the bedclothes, and thus, can be efficiently suctioned.

Thirdly, the ultraviolet sterilization lamp is operated to emit ultraviolet rays to a cleaning target surface during a cleaning process, thereby killing dust mites and germs.

Fourthly, when the first sensor senses that the cleaner main body is spaced apart from a cleaning target surface, the operation of the ultraviolet sterilization lamp is stopped to prevent ultraviolet rays from being emitted to a user or a person near the user.

Fifthly, when the second sensor senses that the filter part is installed, the vacuum motor is operated; and when the second sensor senses that the filter part is not installed, the vacuum motor is not operated, thereby preventing a cleaning process from being unnecessarily performed without the filter part.

<DESCRIPTION OF THE SYMBOLS>

1: VACUUM CLEANER 10: CLEANER MAIN BODY
11: HANDLE 20: ELECTRIC WIRE
30: WHEEL 40: FIRST SENSOR
50: AIR SUCTION PART 51: AIR SUCTION ROOM
52: VACUUM MOTOR 60: FILTER PART
61: CONTAINER 62: PRIMARY FILTER
63: SECONDARY FILTER 70: DUST SUCTION PART
71: STATIONARY TUBE 72: FIXING MEMBER
73: SUCTION TUBE 80: BEATING DEVICE
81: BEATING MOTOR 82: CAM MEMBER
83: BEATING PART 84: LINK MEMBER
90: ULTRAVIOLET STERILIZATION LAMP 100: CONTROL PART
101: LCD WINDOW 102: PRINTED CIRCUIT BOARD
110: SECOND SENSOR 120: REFLECTIVE PLATE

DETAILED DESCRIPTION

Hereinafter, a vacuum cleaner according to preferred embodiments of the present invention will be described in detail with reference to the accompanying drawings.

Figure 1:
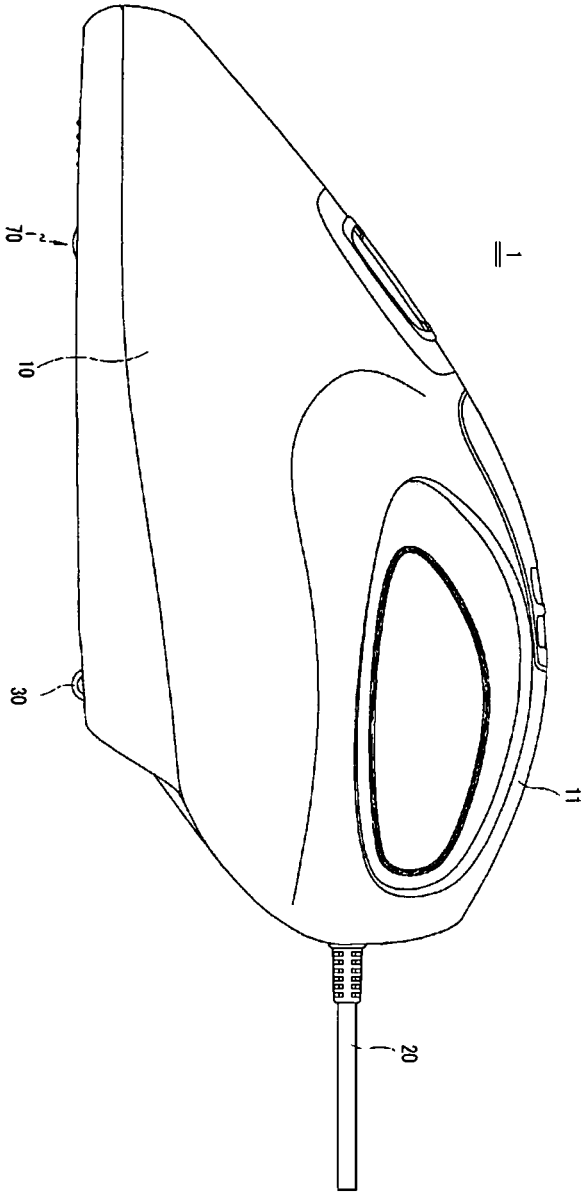
FIG. 1 is a side view illustrating a vacuum cleaner according to an embodiment of the present invention.
Figure 2:
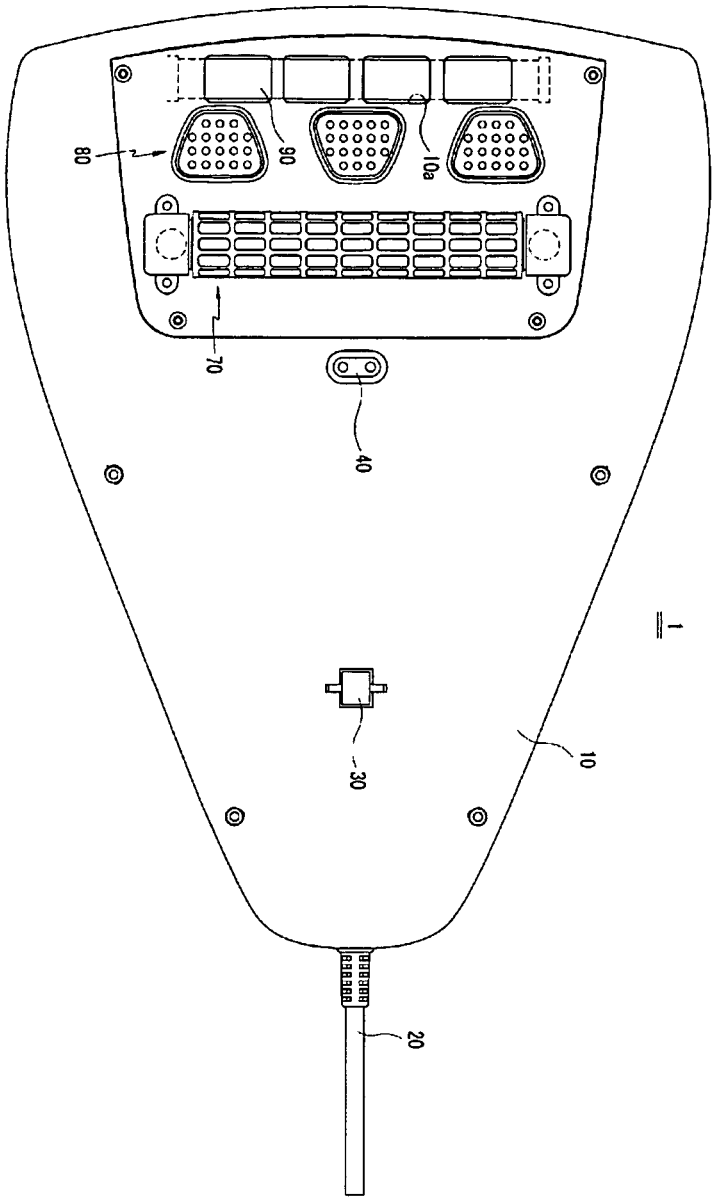
FIG. 2 is a bottom view illustrating the vacuum cleaner of FIG. 1.

FIG. 1 is a side view illustrating a vacuum cleaner according to an embodiment of the present invention. FIG. 2 is a bottom view illustrating the vacuum cleaner of FIG. 1.

A vacuum cleaner 1 according to the current embodiment includes a cleaner main body 10 including a handle 11 in the upper portion thereof. An electric wire 20 is connected to the rear portion of the cleaner main body 10 to receive external power. A wheel 30 rolling along a cleaning target surface, and a dust suction part 70 to be described later are disposed on the bottom of the cleaner main body 10.

A beating device 80 and an ultraviolet sterilization lamp 90 to be described later are disposed on the cleaner main body 10, and are spaced apart from the dust suction part 70. A first sensor 40 is disposed on the bottom of the cleaner main body 10 behind the dust suction part 70. When the cleaner main body 10 is raised, the first sensor 40 senses the raising of the cleaner main body 10 to automatically stop an operation of the ultraviolet sterilization lamp 90. The first sensor 40 is an ultraviolet (IR) sensor. Ultraviolet ray passing holes 10*a* are disposed in the bottom of the cleaner main body 10. Ultraviolet rays emitted from the ultraviolet sterilization lamp 90 pass through the ultraviolet ray passing holes 10*a*.

Figure 3:
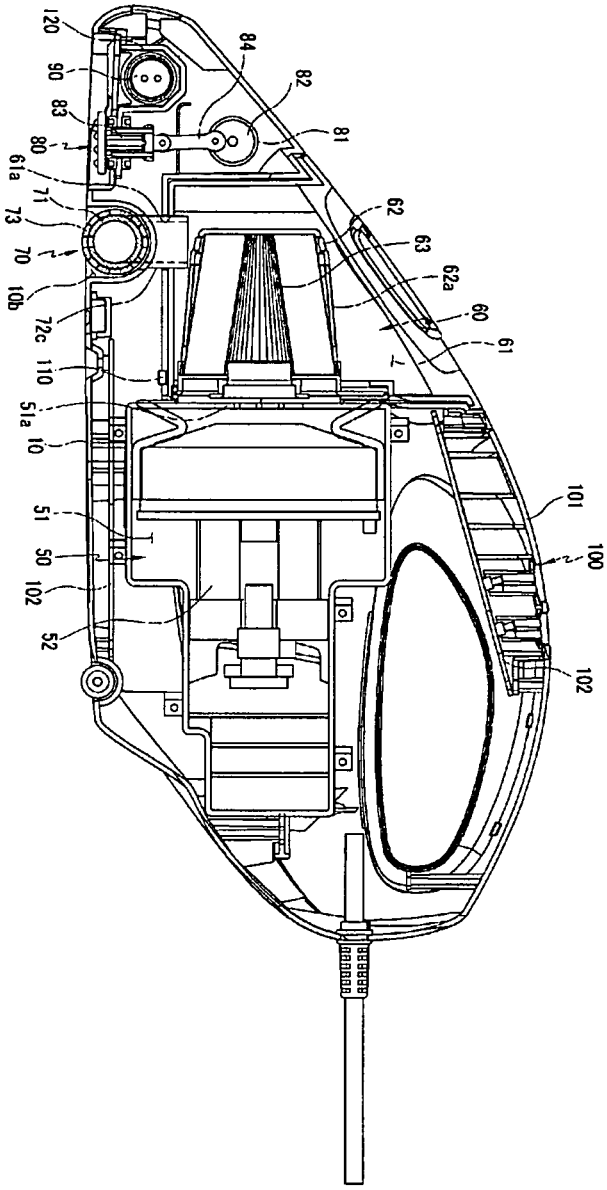
FIG. 3 is a cross-sectional view illustrating the vacuum cleaner of FIG. 1.

FIG. 3 is a cross-sectional view illustrating the vacuum cleaner of FIG. 1.

The cleaner main body 10 is provided with an air suction part 50, a filter part 60, the dust suction part 70, the beating device 80, the ultraviolet sterilization lamp 90, a control part 100, and a second sensor 110.

The air suction part 50 is disposed in the inner rear portion of the cleaner main body 10 to suction external air through the dust suction part 70. The air suction part 50 includes an air suction room 51 and a vacuum motor 52 disposed within the air suction room 51 to form a vacuum within the air suction room 51 thereby introducing external air. Air introduction holes 51*a* are disposed in a side portion of the air suction room 51 to receive air introduced through the filter part 60.

The filter part 60 contacts a side of the air suction room 51 to filter dust mites and a foreign substance such as dust suctioned by the dust suction part 70. The filter part includes: a container 61 removably installed in the cleaner main body 10 through the upper portion thereof to contain a large foreign substance such as paper or hairs; a primary filter 62 disposed within the container 61 to filter a large foreign substance; and a secondary filter 63 disposed within the primary filter 62 to filter fine dust.

Transfer tube insertion holes 61*a* are disposed in the lower portion of the container 61. Transfer tubes 72*c* to be described later are inserted in the transfer tube insertion holes 61*a*, and constitute the dust suction part 70. Thus, when the vacuum motor 52 is operated, not only air but also a foreign substance such as dust and dust mites are introduced into the container 61 through the transfer tubes 72*c*. The primary filter 62 includes a filtering net 62*a* that filters a large foreign substance and passes air and fine dust. The secondary filter 63 passes air and filters fine dust.

When the vacuum motor 52 is operated, the dust suction part 70 suctions air, a foreign substance such as dust, and dust mites from the outside of the vacuum cleaner 1. The dust suction part 70 is installed within an installation recess 10*b* that is laterally elongated in the bottom of the cleaner main body 10. The dust suction part 70 includes: a stationary tube 71 fixed within the installation recess 10*b*; a suction tube 73 rotatably installed on the outer circumferential surface of the stationary tube 71; and the transfer tubes 72*c* for transferring a foreign substance and air suctioned through the suction tube 73 and the stationary tube 71, to the filter part 60.

The beating device 80 is disposed within the cleaner main body 10, and is spaced forward from the dust suction part 70. During a cleaning process, the beating device 80 beats bedclothes such as a blanket to remove a foreign substance such as dust, dust mites, or germs therefrom. The beating device 80 includes: a beating motor 81 disposed within the cleaner main body 10; a cam member 82 coupled to a driving shaft of the beating motor 81; a beating part 83 allowed to protrude from the bottom of the cleaner main body 10; and a link member 84 having an upper end eccentrically hinged to the cam member 82 at a side of the driving shaft, and a lower end hinged to the upper end of the beating part 83.

The ultraviolet sterilization lamp 90 is disposed within the cleaner main body 10, and is spaced forward from the beating device 80 to sterilize a floor or bedclothes such as a blanket by using ultraviolet rays during a cleaning process. Thus, dust mites and various germs inhabiting the floor or bedclothes are killed. Like the dust suction part 70, the ultraviolet sterilization lamp 90 is laterally elongated within the cleaner main body 10. A reflective plate 120 is disposed above the ultraviolet sterilization lamp 90, and surrounds the upper portion thereof to downwardly reflect light emitted from the ultraviolet sterilization lamp 90. The ultraviolet sterilization lamp 90 includes a quartz tube to transmit at least about 90% of ultraviolet rays.

The control part 100 controls the vacuum motor 52 of the air suction part 50, the beating motor 81 of the beating device 80, and the ultraviolet sterilization lamp 90. The control part 100 includes: a liquid crystal display (LCD) window 101 adjacent to the handle 11 disposed in the upper portion of the cleaner main body 10 such that a user selects respective operations of devices through the LCD window 101; and two printed circuit boards 102, one of which is disposed under the LCD window 101 and the other is disposed within the inner lower portion of the cleaner main body 10.

The second sensor 110 is disposed under the filter part 60 within the cleaner main body 10, and senses a removal of the filter part 60 from the cleaner main body 10 to automatically stop an operation of the vacuum motor 52. Furthermore, when the vacuum motor 52 is in a stopped state, even though a user presses a button on the LCD window 101 to operate the vacuum motor 52, the stopped state of the vacuum motor 52 is maintained by means of the second sensor 110. The second sensor 110 is an ultraviolet (IR) sensor.

Figure 4:
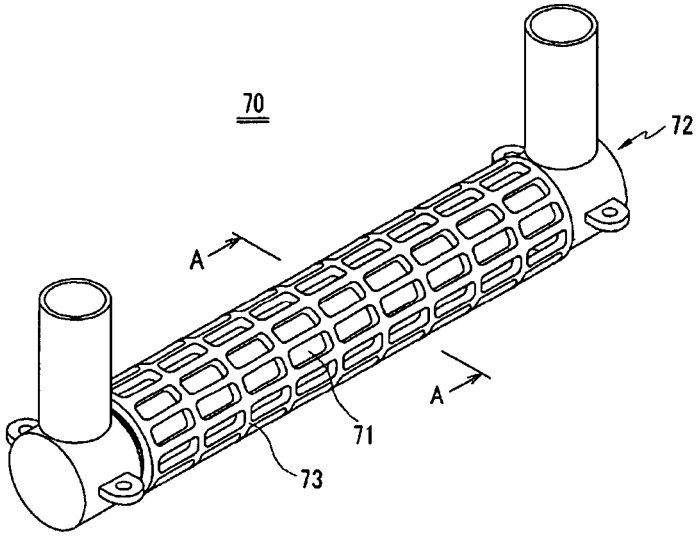
FIG. 4 is a perspective view illustrating a dust suction part illustrated in FIGS. 2 and 3.
Figure 5:
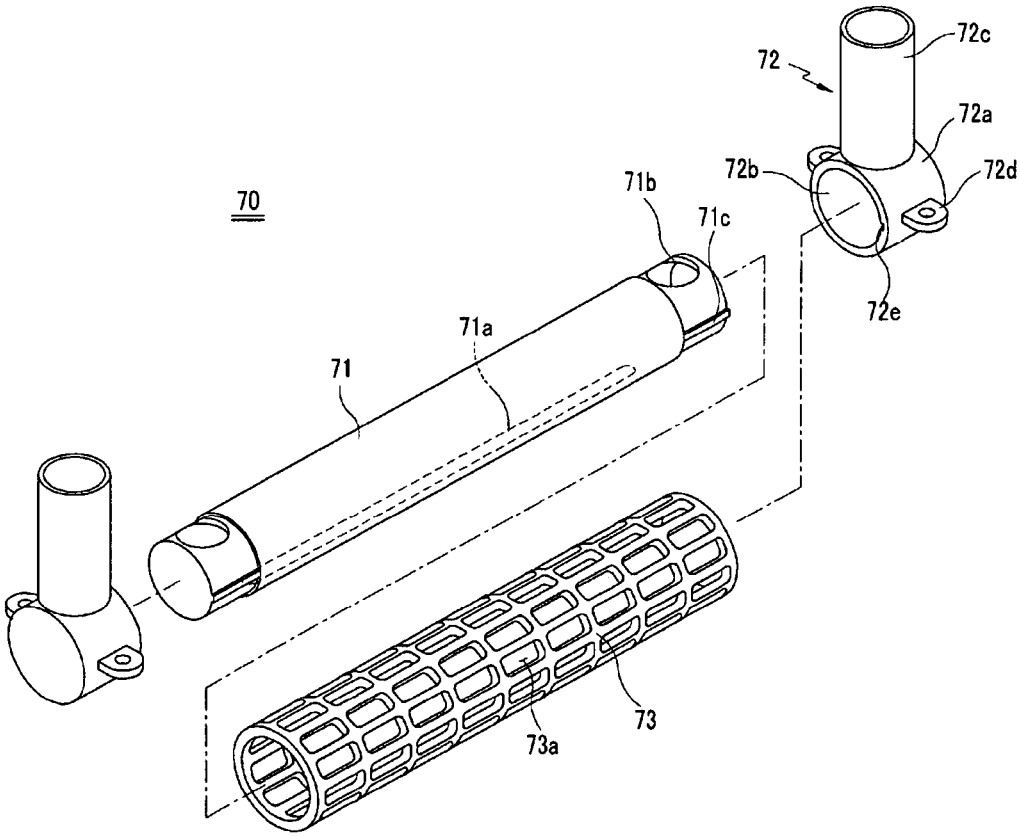
FIG. 5 is an exploded perspective view illustrating the dust suction part illustrated in FIG. 4.
Figure 6:
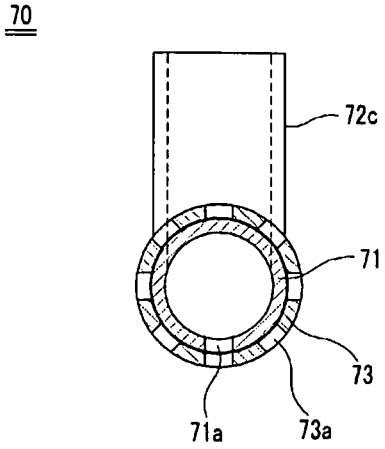
FIG. 6 is a cross-sectional view taken along line A-A of FIG. 4.

FIG. 4 is a perspective view illustrating the dust suction part illustrated in FIGS. 2 and 3. FIG. 5 is an exploded perspective view illustrating the dust suction part illustrated in FIG. 4. FIG. 6 is a cross-sectional view taken along line A-A of FIG. 4.

The dust suction part 70 includes: the stationary tube 71 fixed within the installation recess 10*b* and having a cylindrical shape; a plurality of fixing members 72 fixing the stationary tube 71 within the installation recess 10*b*; and the suction tube 73 rotatably installed on the outer circumferential surface of the stationary tube 71 to suction air and a foreign substance such as dust from the outside thereof.

A dust introduction hole 71*a* is disposed in the lower portion of the stationary tube 71 along the longitudinal direction thereof to introduce air and a foreign substance such as dust suctioned through the suction tube 73. Dust discharge holes 71*b* are disposed in both ends of the stationary tube 71, respectively, to discharge air and a foreign substance such as dust introduced through the dust introduction hole 71*a*, to the fixing member 72. When the entire area of the dust introduction hole 71*a* is equal to the entire area of the air introduction hole 51*a* disposed in a side portion of the air suction room 51, suction efficiency for suctioning air and a foreign substance such as dust from the outside is maximized.

The fixing members 72 not only fix the stationary tube 71 within the installation recess 10*b*, but also transfer air and a foreign substance such as dust discharged through the dust discharge holes 71*b* of the stationary tube 71, to the filter part 60. The fixing member 72 includes: a stationary tube fixing part 72*a* having a space therein and a stationary tube insertion hole 72*b* at a side thereof to receive an end of the stationary tube 71; and the transfer tube 72*c* integrally formed with the stationary tube fixing part 72*a*, and having an end fitted in the transfer tube insertion hole 61*a* of the filter part 60. Brackets 72*d* are disposed on both sides of an outer surface of the stationary tube fixing part 72*a*, respectively. Screws pass through the brackets 72*d* to fix the stationary tube fixing part 72*a* within the installation recess 10*b*. The dust discharge holes 71*b* of the stationary tube 71 communicate with the transfer tubes 72*c* to transfer air and a foreign substance such as dust discharged from the dust discharge holes 71*b*, to the filter part 60 through the transfer tubes 72*c*. Key seats 72*e* are disposed in the inner portions of the stationary tube fixing parts 72*a*. Keys 71*c* are disposed on the outer circumferences of both ends of the stationary tube 71, and are fitted in the key seats 72*e* so as to prevent rotation of the stationary tube 71.

The suction tube 73 is rotatably installed on the entire outer circumferential surface of the stationary tube 71 except for both the ends fitted in the fixing members 72. Dust suction holes 73*a* are disposed in the circumference of the suction tube 73 to suction air and a foreign substance such as dust from the outside thereof.

Hereinafter, a cleaning process using a vacuum cleaner configured as described above will now be described in detail according to another embodiment of the present invention.

First, a user opens a filter part cover disposed in the upper portion of the cleaner main body 10 to install the filter part 60 within the cleaner main body 10, and then, closes the filter part cover. Subsequently, a button of the LCD window 101 is pressed to operate the vacuum motor 52, thereby forming a vacuum within the air suction room 51 and the filter part 60.

When a vacuum is formed within the air suction room 51 and the filter part 60, the user holds the handle 11, and moves the cleaner main body 10 with the bottom thereof on a floor as a cleaning target, or on bedclothes such as a blanket. When the cleaner main body 10 is moved on bedclothes as a cleaning target, the LCD window 101 is manipulated to operate the beating motor 81.

The ultraviolet sterilization lamp 90 can be used for both a floor and bedclothes. When the user holds the handle 11, and pushes and pulls the cleaner main body 10 to clean bedclothes, the ultraviolet sterilization lamp 90 kills dust mites and various germs inhabiting the bedclothes, and the beating motor 81 vertically moves the beating part 83 to beat the bedclothes. While the beating part 83 beats the bedclothes, dust, dust mites, and germs are removed from the bedclothes.

The dust, dust mites, and germs removed from the bedclothes are suctioned into the dust suction holes 73*a* of the suction tube 73, and are transferred to the filter part through the dust introduction hole 71*a* and the dust discharge holes 71*b* of the stationary tube 71, and the transfer tubes 72*c*.

Among the dust, dust mites, and germs transferred to the filter part 60, large particles are primarily filtered out through the primary filter 62, and fine particles are secondarily filtered out through the secondary filter 63. The dust, dust mites, and germs filtered by the primary filter 62 and the secondary filter 63 are collected in the container 61.

Air, suctioned together with the dust, dust mites, and germs, passes through the secondary filter 63, and is then introduced into the air suction room 51, and is then discharged to the rear side of the cleaner main body 10.

While the bedclothes are cleaned, the suction tube 73 disposed on the outer circumferential surface of the stationary tube 71 is continually rotated, thus preventing a portion of the bedclothes from being suctioned into the suction tube 73 and the stationary tube 71. Hence, the user can efficiently and conveniently clean the bedclothes.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A vacuum cleaner comprising:

a stationary tube laterally fixed to a bottom of a cleaner main body to suction dust from an outside by an operation of a vacuum motor disposed within the cleaner main body;

a pair of fixing members fixing both ends of the stationary tube to the cleaner main body, and transferring the suctioned dust to a filter part disposed within the cleaner main body;

a suction tube rotatably installed on an outer circumferential surface of the stationary tube, and rolling along a cleaning target surface, and comprising dust suction holes in a circumferential surface thereof to suction dust; and a beating device on the cleaner main body in front of the stationary tube to beat a cleaning target surface;

wherein the beating device comprises:

a beating motor disposed within the cleaner main body;

a cam member coupled to a driving shaft of the beating motor;

a beating part allowed to protrude from the bottom of the cleaner main body; and a link member having an upper end hinged to the cam member, and a lower end hinged to an upper end of the beating part.

2. The vacuum cleaner of claim 1, wherein a dust introduction hole is disposed in a lower portion of the stationary tube and is elongated along the longitudinal direction of the stationary tube to introduce dust suctioned through the dust suction holes of the suction tube, the fixing members comprise transfer tubes, respectively, which transfer the dust introduced through the dust introduction hole, to the filter part, and the suction tube rotates, entirely surrounding a portion of the outer circumferential surface of the stationary tube between the fixing members.

3. The vacuum cleaner of claim 2, wherein the fixing members comprise stationary tube insertion holes in which both the ends of the stationary tube are inserted, key seats are disposed in inner portions of the stationary tube insertion holes, and keys are disposed on circumferences of both the ends of the stationary tube, and are inserted in the key seats to prevent rotation of the stationary tube.

4. The vacuum cleaner of claim 1, further comprising an ultraviolet sterilization lamp on the cleaner main body in front of the stationary tube.

5. The vacuum cleaner of claim 4, further comprising:

a first sensor disposed on the bottom of the cleaner main body, wherein when the cleaner main body is raised from a floor, the first sensor senses the raising of the cleaner main body to stop an operation of the ultraviolet sterilization lamp; and a second sensor disposed within the cleaner main body, and sensing a removal of the filter part to stop an operation of the vacuum motor.

6. The vacuum cleaner of claim 2, wherein an entire area of the dust introduction hole is equal to an entire area of an air introduction hole disposed in a side portion of an air suction room accommodating the vacuum motor.

* * * * *